US005842601A

United States Patent [19]

Pierpoint

[11] Patent Number: 5,842,601

[45] Date of Patent: Dec. 1, 1998

[54] COMBINATION NIGHT STICK AND IRRITANT DISPENSER

[76] Inventor: James W. Pierpoint, 4610 Yuma Ct., Winston Salem, N.C. 27107

[21] Appl. No.: 959,202

[22] Filed: Oct. 28, 1997

[51] Int. Cl.[6] ..... B65D 83/22

[52] U.S. Cl. ..... 222/1; 222/192; 222/402.1; 222/402.11; 222/153.03; 222/153.11; 222/113; 463/47.4; D22/117

[58] Field of Search ..... 222/1, 175, 153.03, 222/192, 153.11, 402.1, 113, 402.11, 402.15; 463/47.2, 47.4; D22/117

[56] References Cited

U.S. PATENT DOCUMENTS

| | | | |
|---|---|---|---|
| D. 334,790 | 4/1993 | Jaramillo | D22/117 |
| 3,385,601 | 5/1968 | Black | 463/47.4 |
| 3,635,374 | 1/1972 | Anketell | 222/78 |
| 3,730,390 | 5/1973 | Adrian et al. | 222/79 |
| 3,756,467 | 9/1973 | Anketell | 222/78 X |
| 5,086,377 | 2/1992 | Roberts | 222/192 |
| 5,197,734 | 3/1993 | Ashihara | 463/47.4 |
| 5,242,349 | 9/1993 | Reiff et al. | 222/192 X |
| 5,370,407 | 12/1994 | Whalen | 280/809 |
| 5,405,134 | 4/1995 | Wolfram | 463/47.4 |
| 5,446,985 | 9/1995 | Chen | 42/1.08 |
| 5,529,215 | 6/1996 | Banks et al. | 222/402.1 X |

OTHER PUBLICATIONS

ABS promotional flier from Advanced Monobloc describing ABS Barrier Assembly (No Date).

*Primary Examiner*—Kenneth Bomberg

[57] ABSTRACT

A combination night stick and irritant dispenser is presented in which an irritant dispenser is contained in one end of the night stick and a key lock is positioned in the other end. A slidable actuator encircles the night stick and by sliding the actuator forward a pepper spray or other irritant can be dispensed for protection against assailants or others.

20 Claims, 6 Drawing Sheets

COMBINATION NIGHT STICK AND IRRITANT DISPENSER

BACKGROUND OF THE INVENTION

1. Field of the Invention

This invention pertains to a pepper spray dispenser disposed within a night stick for protection and security purposes.

2. Description of The Prior Art And Objectives Of The Invention

In recent years, crime levels have increased in all but a few cities. Of special concern to many individuals is the rise in violent crimes typified by assaults, robberies and break-ins. To combat the rising tide of crime a number of personal self-defense devices have become popular to deter assailants. Because many state statutes and even certain individuals frown on the use of lethal force, weapons such as handguns and knives are considered unacceptable modes of deterring assailants and non-lethal devices have proliferated. For night watchmen who are not allowed to carry a fire arm, non-lethal protection devices are especially useful.

Foremost among non-lethal devices are mace or pepper spray dispensers. These typically come in a variety of sizes, but generally all of the dispensers have a common shortcoming in that the nozzles resemble conventional aerosol nozzles and must be pointed in the desired direction. In the case of an aerosol nozzle which is generally cylindrically shaped with a radially spray, aiming the nozzle in times of duress or stress, such as when under attack, can be quite difficult. There have been numerous reported incidents of people wielding mace or pepper spray against assailants only to spray themselves, rather than the assailant.

Another common device used by night watch men is a standard night stick. While several devices have disclosed combination tools and spray dispensers such as those found in U.S. Pat. Nos. 5,446,985, 5,370,407, 3,730,390 and Des. 334,790, these devices all have triggers which require specific orientations for personal defense. I.e., not only must the spray nozzle be pointed in the correct direction, but also the user must grasp the handle in a specific fashion to activate the spray. Likewise, these devices may look like a firearm which triggers an assault response in viewers. I.e., a viewer sees what they think is a gun, they panic and launch an attack with lethal weaponry or fierceness.

With the above concerns in mind, it is an objective of the present invention to provide a combination night stick and spray dispenser, which is fool proof and easy to use.

It is a further objective of the present invention to provide a spray dispenser with a point and shoot arrangement, which can be actuated in any radial orientation while pointed at the assailant.

It is yet a further objective of the present invention to provide a night stick that is electrically non-conductive.

It is still a further objective of the present invention to provide a spray dispenser that disperses pepper gas an effective range of 20 to 25 feet in a conical pattern.

It is another objective to provide a night stick with play in the actuator mechanism to decrease the likelihood of inadvertent spraying.

It is yet another objective to provide a spray dispenser with a lock to prevent inadvertent use by children or unauthorized persons.

It is still another objective to provide a night stick which is well suited for use as a quarter staff.

It is a further objective to provide a night stick whose appearance is dissimilar to a firearm, thereby reducing the likelihood of triggering an assault response in nearby viewers.

Other objectives and advantages of the invention will become apparent to those skilled in the art upon further reference to the detailed description below.

SUMMARY OF THE INVENTION

The aforesaid and other objectives are realized by a night stick with an irritant dispenser disposed therein. The night stick includes preferably a polyvinyl chloride (PVC) slidable actuator surrounding an elongated PVC portion to operate the irritant dispenser. The irritant dispenser utilizes conventional "spray at any angle" aerosol technology to dispense a conical spray of irritant such as standard pepper spray twenty to twenty-five feet. A spring within the housing allows the slidable actuator to travel longitudinally up to an inch before the device is actuated to prevent inadvertent spraying as may occur during normal handling. The irritant dispenser is well adapted to use with disposable or refillable cartridges of pepper spray or similar self-defense compounds. A disposable cartridge is contained within one end of the night stick and is held by a threaded aluminum front cap. The cartridge includes a PVC housing, which holds a standard pepper spray can with a nozzle assembly for conical dispersion of the pepper spray.

A conventional key lock is provided at the opposite end of the night stick to prevent unauthorized or inadvertent spraying. The key lock is contained within a rear end cap for manipulating an aluminum rod attached to the slidable actuator, to prevent motion as required. An optional cap may cover the recessed key lock in order to prevent moisture from entering the lock and freezing therein.

DETAILED DESCRIPTION OF THE PREFERRED EMBODIMENT

AND OPERATION OF THE INVENTION

Figure 1:
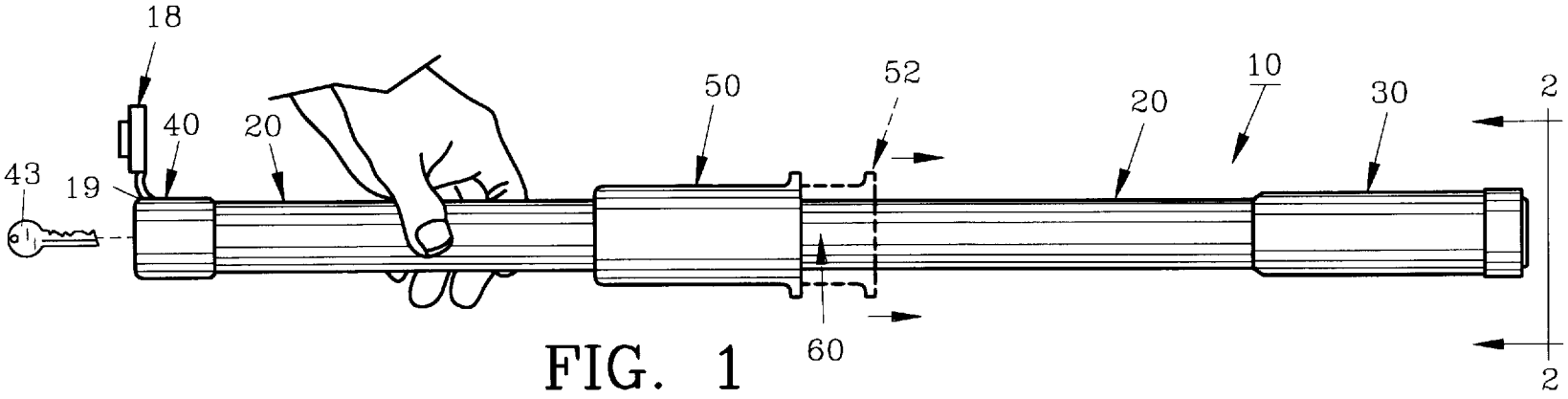
FIG. 1 shows a side elevational view of the preferred embodiment of the present invention.

Turning now to the drawings, FIG. 1 shows a side view of the preferred embodiment of the present invention. Night stick 10 includes elongated portion 20 and slidable actuator 50. Elongated portion 20, with approximate midpoint 60, includes dispensing end 30 and locking end 40. Elongated portion 20 and slidable actuator 50 are preferably made of a non-electrically conductive, rigid material such as polyvinyl chloride (PVC), and may include conventional friction increasing knurls (not shown) formed therein for better grip. Other conventional grips may also be used such as conventional foam grip pads or longitudinal ridges. Elongated portion 20 is generally cylindrical and hollow. Slidable actuator 50 is also cylindrical and surrounds or encircles elongated portion 20 and is generally positioned near midpoint 60 of elongated portion 20. Slidable actuator 50 engages elongated portion 20 and travels towards dispensing end 30 as indicated generally by the arrows and ghost slidable actuator 52 during operation or dispensing of irritants contained therein. Locking end 40 includes cap 18 attached by living hinge 19, which can be plugged over recessed lock 41 to prevent moisture from entering same.

Figure 2:
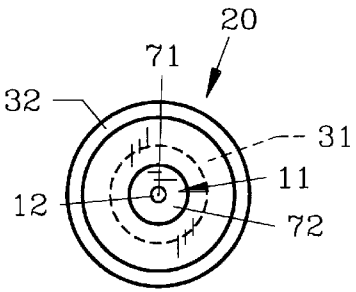
FIG. 2 demonstrates an end view of the dispensing end of the device as seen in FIG. 1 along lines 2—2.
Figure 5:
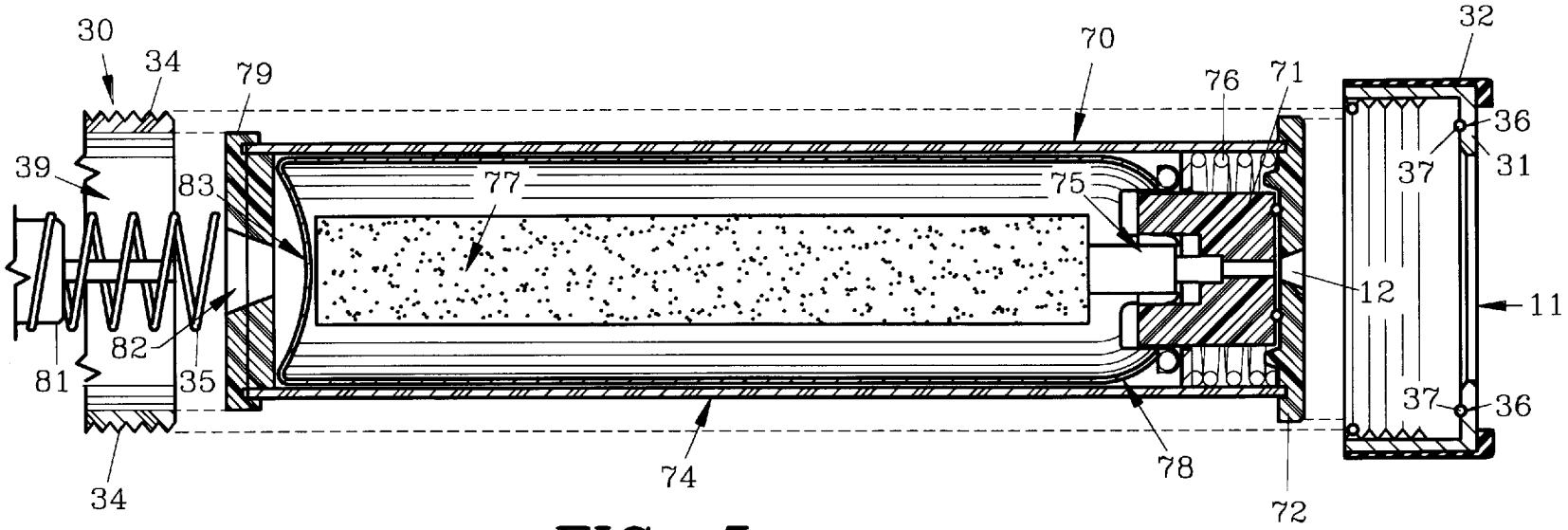
FIG. 5 depicts an enlarged exploded cross sectional view of the dispensing end of the device of FIG. 1.

In FIG. 2, dispensing end 30 is shown with aluminum front cap 31 with rubber exterior surface coat 32. Rubber coat 32 prevents the edges of front cap 31 from cutting when night stick 10 is used as a club or quarter staff for striking assailants, but still allows bruising, which can be desirable. Front cap 72 of cartridge 70 is seen through opening 11 in front cap 31 (see also FIG. 5), and nozzle 71 emits pepper spray 77 through opening 12 in front cap 72 (FIG. 5). As will be described below, front cap 31 threads on to the terminal part of dispensing end 30 and holds cartridge 70 therein.

Figure 3:
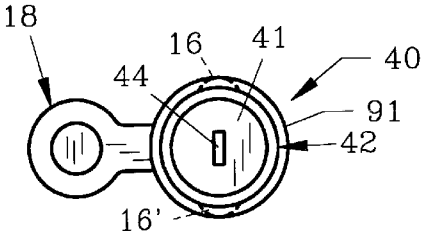
FIG. 3 features the locking end of the device of FIG. 1.

FIG. 3 depicts locking end 40 of preferred night stick 10. Locking end 40 comprises conventional key lock 41 contained recessed within rear end cap 42. Key lock 41 is activated by key 43 (shown in FIG. 1) by insertion of key 41 into slot 44 and rotation thereof as is conventional. Rear cap 42 is cemented to elongated portion 20 by a conventional cement for PVC, or under adverse use conditions preferably riveted to elongated portion 20 by rivets 16, 16' (FIG. 3). Cap 18 is attached to locking end 40 by living hinge 19 and is sized so as to fit over and cap lock 41 to prevent moisture from entering same. Locking end 40 is preferably coated with rubber layer 91 to prevent cutting much as dispensing end 30 is as described above.

Figure 4:
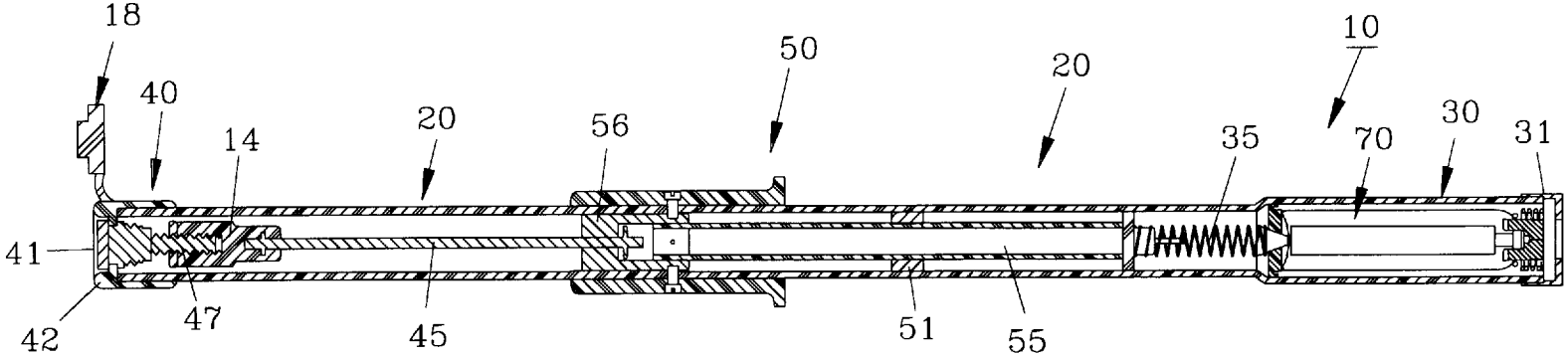
FIG. 4 illustrates a longitudinal cross sectional view of the device of FIG. 1.

In cross sectional FIGS. 4–7 of night stick 10, the primary internal features are exposed. In FIG. 4, lock 41 connects to adapter 14, which in turn is connected to aluminum rod 45. Aluminum rod 45 feeds into main bearing 56, which is connected to exterior slidable actuator 50 and internal PVC push rod 55. Push rod 55 is supported by intermediate bearing 51. Push rod 55 is attached to spring 35, which abuts cartridge 70, better seen in enlarged FIGS. 5–7.

Dispensing end 30 in FIG. 5 shows an enlarged exploded view, including aluminum front cap 31 with rubber coat 32 thereon. Front cap 31 includes annular channel 36 milled on the interior top surface and which is sized so as to accommodate o-ring 37. O-ring 37 fits within channel 36, but extends slightly therefrom in order to form a seal when placed against front cap 72 of cartridge 70 as when interior threads 33 of front cap 31 are rotated onto exterior threads 34 of dispensing end 30. Additional o-rings are located at the rearward edge of front cap 32 and between nozzle 71 and front cap 72. Cartridge 70 is received by chamber 39 formed by hollow dispensing end 30 and engages spring 35 (FIG. 4).

Cartridge 70 is preferably PVC tube 74 (FIG. 5) with standard pepper spray can 78 within. Can 78 moves within tube 74 although tube 74 is held rigidly in place by front cap 72. Pepper spray can 78 includes conventional "ABS Valve-Pouch Assembly" or valve assembly 75 as sold by Advanced Monobloc at One Llodio Drive, Hermitage, Pa,16148. Valve assembly 75 is preferably spring biased in the closed position by an internal spring (not shown). The interior of can 78 is under pressure, while assembly 75 is not under pressure. While this arrangement is preferred, other conventional aerosol arrangements are possible. Spring 76 biases can 78 and nozzle 71 from front cap 72 and prevents the inertial mass of can 78 from inadvertently dispensing pepper spray 77 when night stick 10 is swung at an assailant. Nozzle 71 is in fluid communication with assembly 75 and pepper spray 77. It should be understood that in use, can 78 is forced towards front cap 72 by manual movement of actuator 50, thereby depressing or actuating nozzle 71 to dispense pepper spray 77 or similar irritant from assembly 75 through nozzle 71 and conically outwardly from nightstick 10. In the preferred embodiment, pepper spray 77 is dispensed in a conical pattern out to twenty to twenty-five (approximately 6–8 meters) feet from dispensing end 30. After a desired amount of pepper spray 77 is dispensed, actuator 50 is released and spring 76 pushes nozzle 71 and can 78 from front cap 72 and closes assembly 75, thereby stopping the expulsion of pepper spray 77.

Prior to use, assembly 75 is filled with pepper spray 77 or other desired irritant and inserted into pepper spray can 78. Compressed air or other gas is directed into can 78 and thereafter sealed under pressure. Pepper spray can 78 is then inserted into PVC tube 74. Nozzle 71 is attached to assembly 75 and front cap 72 is cemented with a conventional cement used for PVC or otherwise attached to tube 74. Disposable cartridge 70 is then placed into chamber 39 of dispensing end 30. Spring 76 is then placed thereon without jostling nozzle 71 to prevent inadvertent discharge. Front cap 31 is then tightened onto threads 34 of dispensing end 30. Tube 74 (FIG. 5) includes annular PVC rear cap 79 which is cemented to tube 74 or tube 74 can be integrally formed with rear cap 79. Annular rear cap 79 allows plug 81, which is attached to push rod 45 and rests within spring 35, to slide through aperture 82 in annular rear cap 79 and press against bottom 83 of can 78. As noted above, can 78 can slide within tube 74. This in turn urges can 78 forward and presses nozzle 71 against front cap 72 causing pepper spray 77 to be dispensed. It should be understood that nozzle 71, when used with valve assembly 75, effectively allows dispersion of pepper spray 77 at any angle including when night stick 10 is tilted or otherwise in a non-horizontal orientation.

Spring 35 is designed to compress approximately one inch or 2.54 cm before plug 81 moves through rear cap 79 and engages bottom of can 83. This 2.54 cm space acts as a safety mechanism to prevent inadvertent triggering or dispensing as when night stick 10 is casually brushed against an object or inadvertently impacted. Aperture 82 is preferably small enough that a human child's finger will not fit through aperture 82 and thus cannot inadvertently press against bottom 83 to dispense pepper spray 77.

Figure 6:
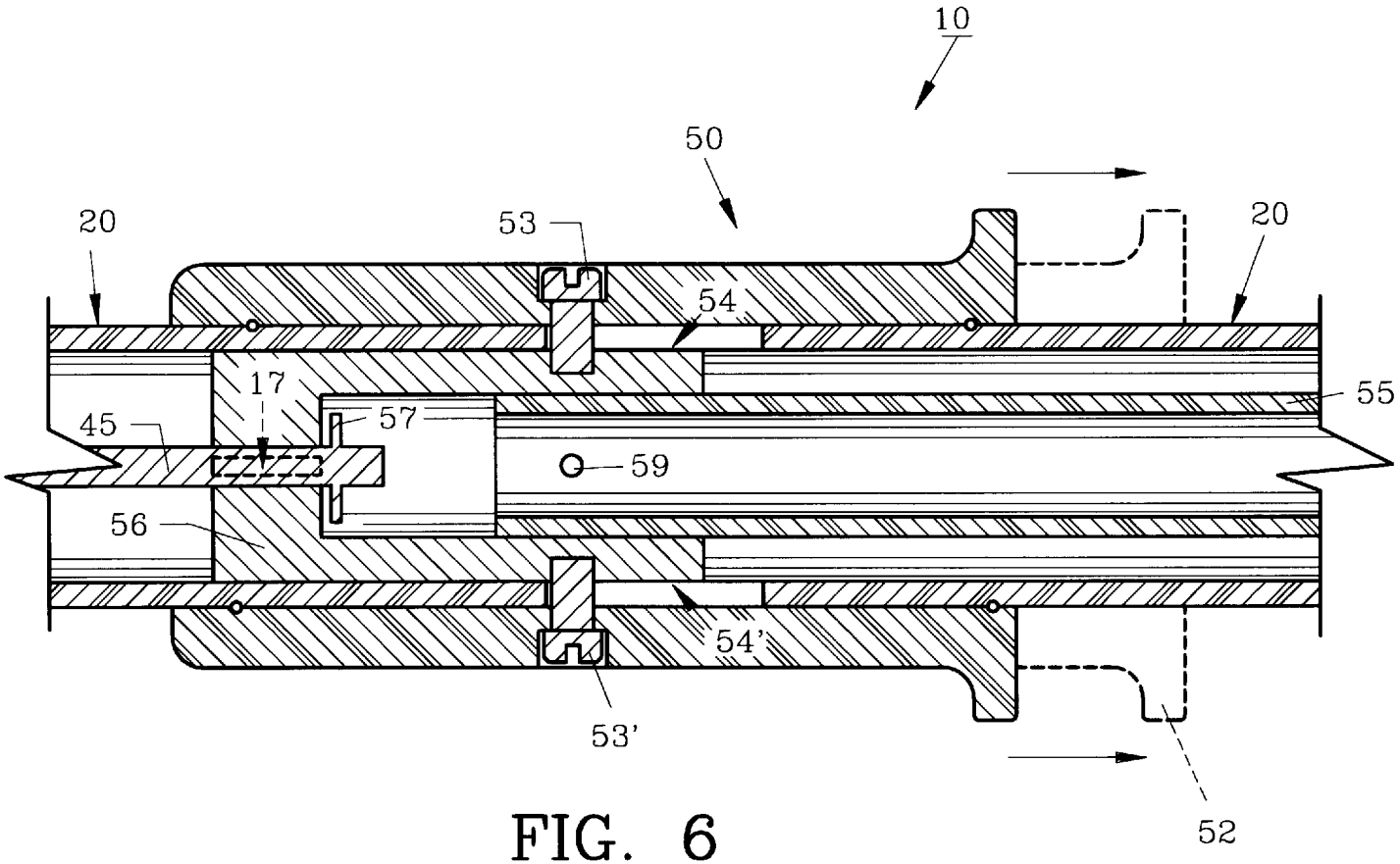
FIG. 6 pictures an enlarged cross sectional view of the slidable actuator of the device of FIG. 1 with dashed lines to illustrate actuator movement.

FIG. 6 depicts slidable actuator 50 which includes shoulder screws 53 and 53'. Screws 53 and 53' ride in slots 54 and 54' respectively, thereby allowing slidable actuator 50 to linearly slide while engaging elongated portion 20 of night stick 10. Screws 53 and 53' extend through slots 54 and 54' to threadably engage main bearing 56. Main bearing 56 is rigidly attached to push rod 55 by roll pin 59. When slidable actuator 50 is activated (moved towards dispensing end 30), screws 53 and 53' drive main bearing 56 and push rod 55 in the same direction. Push rod 55 directly moves with slidable actuator 50 and compresses spring 35 (FIG. 4) for dispensing of pepper spray 77.

Figure 7:
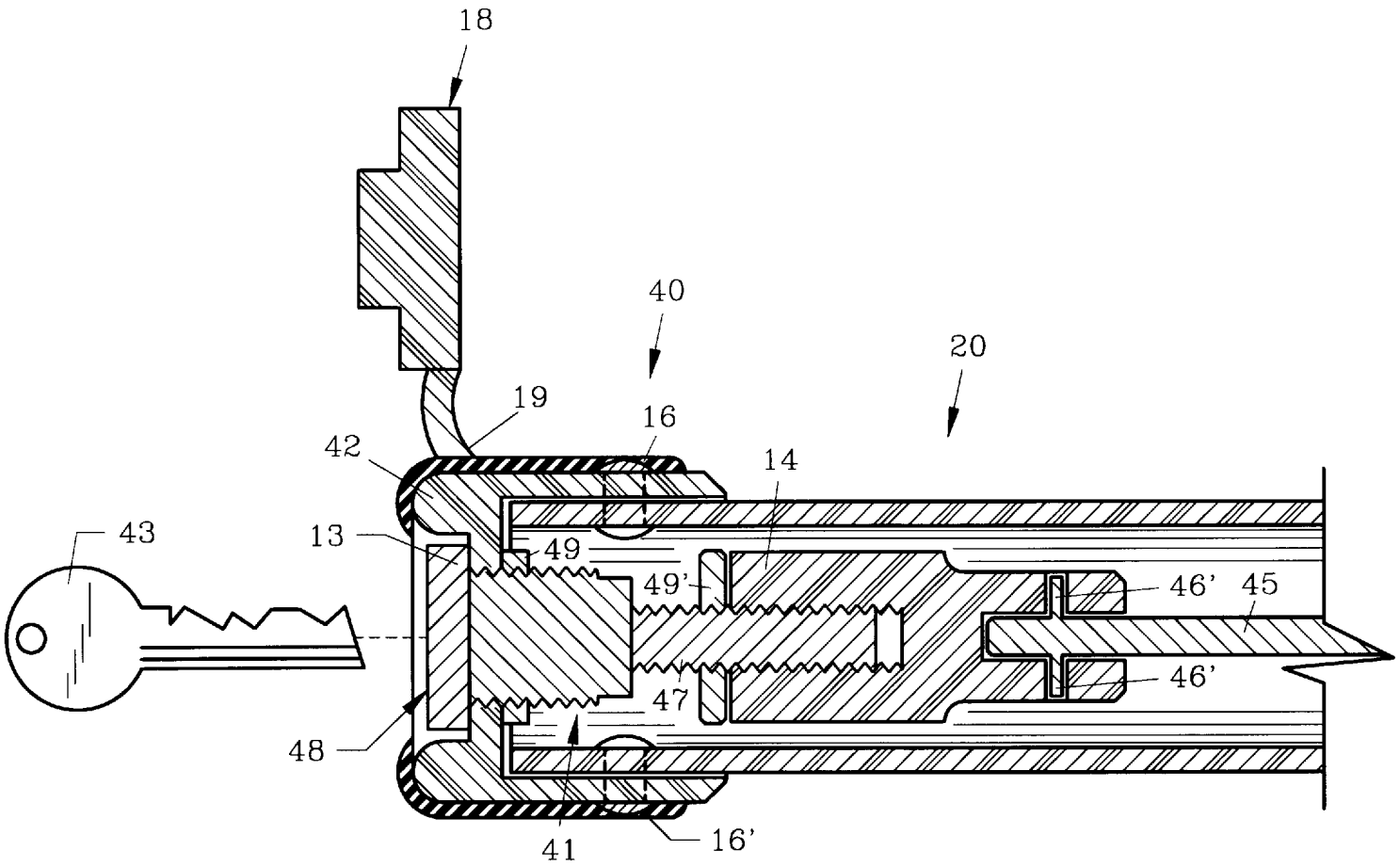
FIG. 7 shows an enlarged cross sectional view of the locking end of the device of FIG. 1 with the key removed.

Slidable actuator 50 includes a means for locking so that slidable actuator 50 may not inadvertently or accidentally activate can 78. Key 43 as seen in FIG. 7, through adapter 47 turns aluminum rod 45 and roll pin 57 thereon. In the locked position, as shown in FIG. 6, roll pin 57 is positioned vertically, and does not allow main bearing 56 to move longitudinally, i.e. towards dispensing end 30 (left to right in FIG. 6). When aluminum rod 45 is turned by key 43 to the unlocked position, roll pin 57 rotates within and aligns with longitudinal slots 17 (one shown in dotted lines) which extend the length of main bearing 56 parallel to aluminum rod 45. Roll pin 57 is thus free to slide within longitudinal slots 17, thereby allowing main bearing 56 to move towards dispensing end 30 and dispense pepper spray 77 when slidable actuator 50 is urged forward as previously described. Main bearing 56 moves with slidable actuator 50, but is sized so that rod 45 and roll pin 57 never break contact with main bearing 56, i.e. they never slide out of main bearing 56. Slidable actuator 50 includes two o-rings which effectively prevent moisture from entering between actuator 50 and elongated portion 20.

FIG. 7 features locking end 40 of night stick 10. Conventional metal key lock 41 is mounted in a recessed manner in rear end cap 42 and accommodates metal key 43. Rear end cap 42 is riveted to elongated portion 20 by rivets 16 and 16'. Key lock 41 includes threaded shaft 47 and threaded main body 48. Key lock 41 is placed through an aperture in end cap 42 and metal lock nut 49 is threaded onto main body 48 thereby sandwiching end cap 42 between flange 13 and lock nut 49. A washer (not shown) may be placed on threaded shaft 47 prior to lock nut 49 as is conventional for spacing or security purposes. Lock nut 49' is threaded onto shaft 47 and PVC adapter 14 is threaded thereon. After adapter 14 is threaded onto shaft 47, lock nut 49' is positioned flush against adapter 14 as is conventional to prevent shaft 47 from rotating relative to adapter 14. Aluminum rod 45 is rigidly affixed to adapter 14 by roll pin 46. Plastic cap 18 with living hinge 19 may also be used to prevent moisture from entering slot 44 as described above.

Key lock 41 has locked and unlocked positions. In the locked position, as described above, slidable actuator 50 will not move and pepper spray 77 cannot be dispensed. By inserting key 43 and turning it 90°, key lock 41 is unlocked. Roll pin 46 of adapter 47 turns with key 43 and rotates aluminum rod 45 so that rod 45 positioned in main bearing 56 rotates within slots 17 as described above. This provides an added safety feature if key lock 41 is locked and key 43 removed, pepper spray 77 can not be released. In this manner, night stick 10 can be safely stored around small children without fear of inadvertent spraying.

Figure 8:
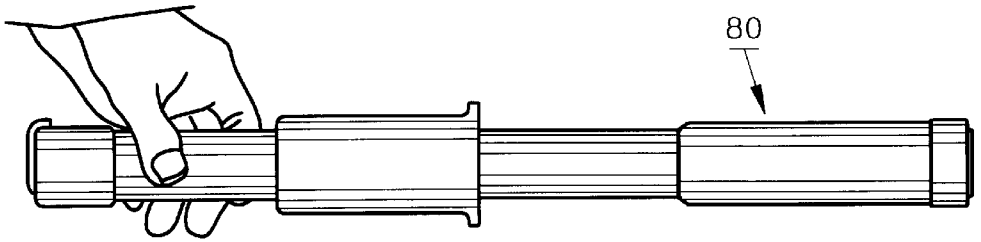
FIG. 8 illustrates an alternate shorter embodiment of the device seen in FIG. 1.

FIG. 8 shows an alternate embodiment of shorter night stick 80, which is substantially identical to night stick 10. It should be understood that night stick 10, while preferably 36 inches or just under a meter in length, may be longer or shorter as needed to accommodate smaller or larger wielders. Contemplated ranges include 45.72 cm to 152.4 cm, although other sizes could be made. It is understood that a longer embodiment may be used more as a quarter staff than a true night stick in that assailants may be warded off with a jabbing action rather than swinging the night stick like a club. It is also understood that the longer embodiments have a much larger defensive radius than the shorter embodiments.

Figure 9:
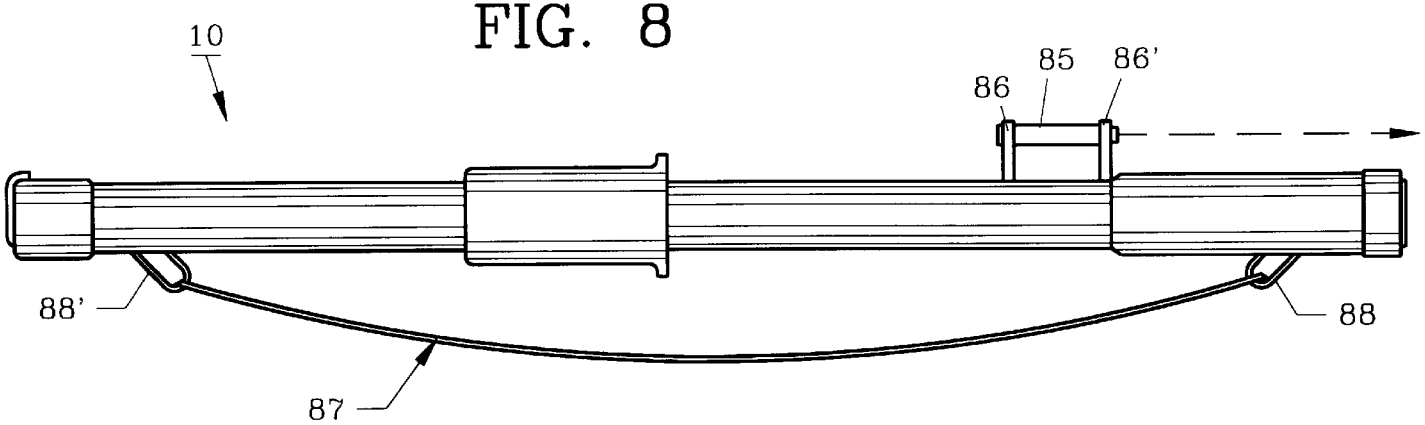
FIG. 9 features another embodiment of the night stick of the invention with optional features.

Optional features are seen in FIG. 9, which may be added to night stick 10. Conventional laser sight 85 can be used to make sure that dispensing end 30 is correctly aimed. Mounts 86, 86' secure laser sight 85 to dispensing end 30 by a conventional PVC adhesive. In addition, leather strap 87 is attached by clips 88 and 88' for over-the-shoulder carrying. Other modifications are within the scope of the present invention, such as providing an infrared illuminator (not shown) mounted on dispensing end 30 for use with IR goggles or other night vision gear. Elongated portion 20 may be sand blasted or subjected to other comparable finishing techniques in order to provide a non-reflective finish. While night stick 10 is preferably formed from PVC in order to maintain its electrically non-conductive nature, other materials are possible and contemplated such as steel, iron, wood, or other polymeric materials but such are not preferred for weight, economy, strength and conduction reasons.

Figure 10:
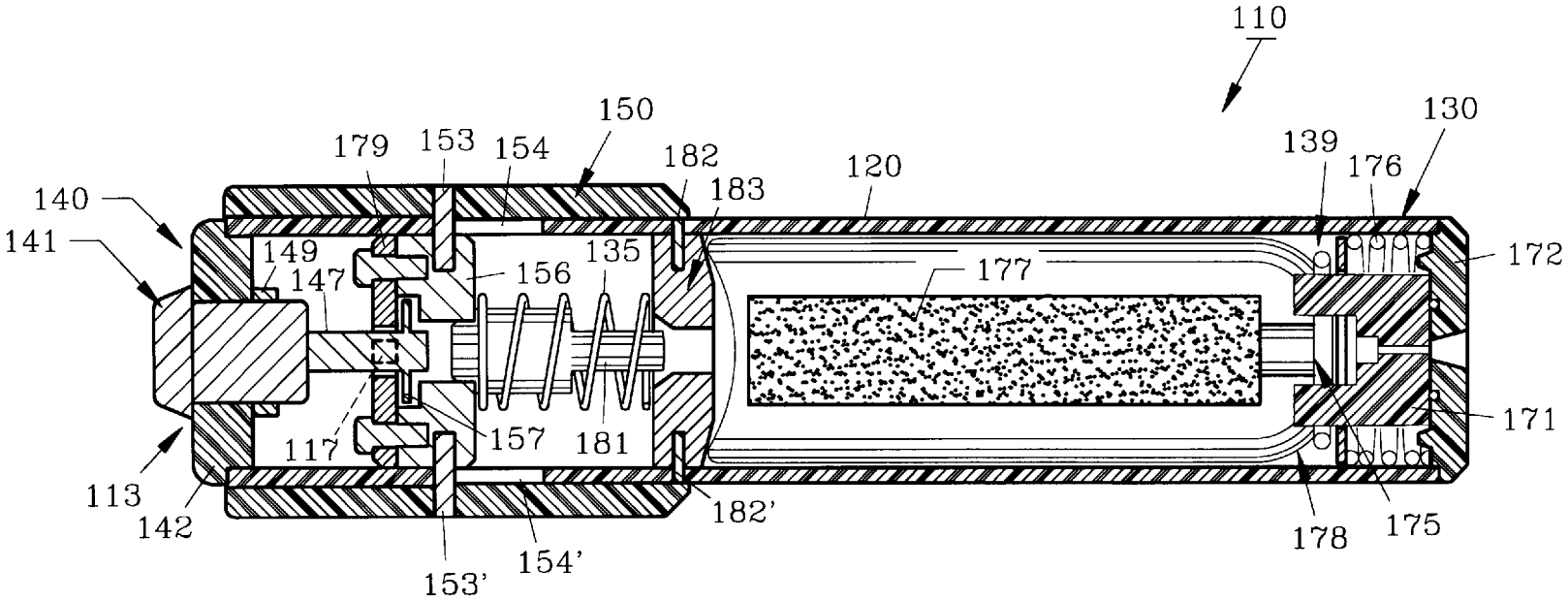
FIG. 10 demonstrates a cross sectional view of a small, alternate embodiment of the present invention.

FIG. 10 demonstrates an alternate embodiment of the present invention, namely night stick 110 wherein features that are similar to those found on night stick 10 are denoted by adding 100 to the original identifying number, e.g. elongated portion 20 becomes elongated portion 120. Night stick 110 is much shorter than preferred night stick 10, and is preferably 20.32 cm in length.

Locking end 140 includes key lock 141 which is threaded into rear cap 142. Rear cap 142 is not rubber dipped as in night stick 10. Lock nut 149 secures key lock 141 in place by sandwiching rear cap 142 between lock nut 149 and flange 113 of key lock 141. Rear cap 142 is affixed to elongated portion 120 by a conventional cement. Shaft 147 extends through lock plate 179 and includes roll pin 157 inside main bearing 156. Lock plate 179 is attached to main bearing 156 by a plurality of screws (preferably two). Lock plate 179 includes a pair of slots (one shown in dotted lines) 117 which function similarly to slots 17. Shaft 147 is sufficiently long to extend into main bearing 156 in this embodiment, thus eliminating the need for aluminum rod 45.

Slidable actuator 150 is attached to main bearing 156 by press dowel pins 153 and 153', which ride in slots 154 and 154' respectively. Spring 135 contains plug 181 within and abuts annular rear stop 183. Unlike night stick 10 with a separate disposable or refillable cartridge 70, night stick 110 is a disposable integral unit. Rear stop 183 is affixed to elongated portion 120 by press dowel pins 182 and 182'. Cavity 139 extends from rear stop 183 to annular front cap 172. Front cap 172 is cemented onto elongated portion 120 and thus forms dispensing end 130. Can 178 sits within cavity 139 and includes valve assembly 175 and nozzle 171. Inside can 178 is irritant 177 such as pepper spray.

Night stick 110 functions much like night stick 10. Slidable actuator 150 is moved towards dispensing end 130 along elongated portion 120, thereby compressing spring 135 and allowing plug 181 to pass through annular rear cap 179. Plug 181 then urges can 178 within cavity 139 towards front cap 172 thereby depressing nozzle 171 and causing irritant 177 to be dispensed. Additional spring 176 biases can 178 away from front cap 172 to prevent accidental discharge. Given the size of night stick 110, it is less effective as a night stick, but more suited for use as an irritant dispenser that can be placed in a purse, although night stick 110 can still function as a night stick or small baton to fend off assailants.

The preceding recitation is provided as an example of the preferred and alternate embodiments and is not intended to limit the nature or scope of the present invention as the appended claims.

I claim:

1. A night stick and irritant dispenser in combination, said night stick comprising: an elongated portion and a slidable actuator, said slidable actuator surrounding said elongated portion;

said irritant dispenser comprising:

a) a cartridge, said cartridge positioned in within said night stick;

b) an irritant, said irritant contained within said cartridge; and c) a nozzle, said nozzle positioned on said cartridge and in fluid communication with said irritant, said slidable actuator for operating said nozzle to dispense said irritant from said cartridge.

2. The combination of claim 1 wherein said irritant comprises pepper spray.

3. The combination of claim 1 wherein said slidable actuator engages said elongated portion.

4. The combination of claim 1 further comprising a biasing member, said biasing member proximate said nozzle for biasing said nozzle to an inactive position.

5. The combination of claim 1, further comprising a lock, said lock disposed in said night stick.

6. The combination of claim 5 wherein said lock is positioned within one end of said elongated portion.

7. The combination of claim 5 wherein said lock comprises a key activated lock.

8. The combination of claim 1 wherein said nozzle dispenses said irritant conically.

9. The combination of claim 1 wherein said night stick further comprises a main bearing, a push rod, and a spring, said main bearing located within said elongated portion, said main bearing connected to said slidable actuator, said push rod connected to said main bearing and said spring connected to said push rod, and said spring proximate said cartridge whereby said slidable actuator moves said main bearing, said push rod and said spring to actuate said cartridge.

10. The combination of claim 1 wherein said cartridge is removably positioned within said night stick.

11. The combination of claim 1 wherein said elongated portion is formed from PVC.

12. A night stick comprising:

a) an elongated portion, said elongated portion having a dispensing end;

b) a slidable actuator, said slidable actuator encircling said elongated portion;

c) a cartridge, said cartridge positioned within the night stick;

d) an operable nozzle, said nozzle positioned within said dispensing end, proximate said cartridge, and in fluid communication therewith; and e) an irritant, said irritant contained within said cartridge, whereby said irritant is dispensed from said cartridge through said nozzle when said nozzle is operated.

13. The night stick of claim 12 wherein said slidable actuator engages said elongated portion.

14. The night stick of claim 12 wherein said slidable actuator encircles said elongated portion proximate the midpoint of said elongated portion.

15. A method of using a combination night stick and irritant dispenser, said night stick having an elongated portion and a slidable actuator, said slidable actuator encircling said elongated portion, said slidable actuator slidably engaging said elongated portion, said elongated portion containing an irritant, said method comprising the steps of:

a) pointing the night stick;

b) sliding the encircling actuator along the engaged elongated portion; and c) dispensing the irritant from the night stick.

16. The method of claim 15 further comprising the step of placing a cartridge containing the irritant in the night stick.

17. The method of claim 16 wherein the step of placing the cartridge containing the irritant in the night stick comprises placing the cartridge containing a pepper spray in the night stick.

18. The method of claim 16 further comprising the step of dispensing the irritant until the cartridge is empty, removing the empty cartridge from the night stick prior to placing a fresh cartridge containing an irritant in the night stick.

19. The method of claim 15 wherein pointing the night stick comprises aiming a laser at a desired target.

20. The method of claim 15 further comprising the step of releasing the encircling slidable actuator along the engaged elongated portion to terminate dispensing.

* * * * *